US009781957B2

(12) United States Patent
Mack et al.

(10) Patent No.: US 9,781,957 B2
(45) Date of Patent: Oct. 10, 2017

(54) MULTI MIT

(71) Applicant: The Idea Experts, LLC, Goodyear, AZ (US)

(72) Inventors: John M. Mack, Goodyear, AZ (US); Margaret Mack, Goodyear, AZ (US)

( * ) Notice: Subject to any disclaimer, the term of this patent is extended or adjusted under 35 U.S.C. 154(b) by 0 days.

(21) Appl. No.: 14/961,596

(22) Filed: Dec. 7, 2015

(65) Prior Publication Data

US 2016/0081406 A1 Mar. 24, 2016

Related U.S. Application Data

(63) Continuation of application No. 14/493,269, filed on Sep. 22, 2014, now Pat. No. 9,204,675.

(60) Provisional application No. 61/906,774, filed on Nov. 20, 2013.

(51) Int. Cl.
*A41D 19/00* (2006.01)

(52) U.S. Cl.
CPC ..... *A41D 19/0017* (2013.01); *A41D 19/001* (2013.01); *A41D 19/0013* (2013.01); *A41D 19/0041* (2013.01)

(58) Field of Classification Search
CPC ..... A41D 19/0017; A41D 19/0041; A41D 19/001
See application file for complete search history.

(56) References Cited

U.S. PATENT DOCUMENTS 2,263,327 A * 11/1941 Bjerke ..... A41D 19/0013 2/163
4,654,895 A * 4/1987 Peters ..... A41D 19/0017 2/161.1
6,014,775 A * 1/2000 Missry ..... A63B 71/146 2/161.2
6,338,163 B1 * 1/2002 Markson ..... A41D 19/0017 2/161.6
6,401,254 B1 * 6/2002 Boller ..... A41D 19/0027 116/223
7,363,660 B1 * 4/2008 Gilliland ..... A41D 19/0017 2/159
7,721,353 B2 * 5/2010 Saturnio ..... A41D 19/01 2/158
8,646,115 B1 * 2/2014 Baunach ..... A41D 19/0013 2/158

(Continued)

*Primary Examiner* — Shaun R Hurley
*Assistant Examiner* — Andrew W Sutton
(74) *Attorney, Agent, or Firm* — Schmeiser, Olsen & Watts LLP

(57) ABSTRACT

The technical features of the Multi MIT are the retractable finger points on and/or near the metacarpo-interphalangeal joint on the middle, index and thumb fingers. On the dorsal side of the glove, are magnets that are sewn between the insulated material and the outer fabric which connect when the finger caps are retracted. The finger caps are held back by a positive and a negative magnet on the dorsal side of the glove that firmly holds the finger caps in place. The retracted caps access the inner spandex fleece glove that has touch screen material patches on the tips of the middle, index, and thumb fingers on the palmer side of the inner glove. The inner glove is designed to give the wearer fingertip sensory reception, dexterity and allow touch screen capabilities while providing mild fingertip protection with the finger caps retracted.

4 Claims, 6 Drawing Sheets

(56) References Cited

U.S. PATENT DOCUMENTS

| | | | | |
|---|---|---|---|---|
| 2004/0123371 | A1* | 7/2004 | Bryant, Sr. | A41D 19/01529 2/159 |
| 2005/0193464 | A1* | 9/2005 | Hess | A41D 19/01582 2/160 |
| 2006/0156453 | A1* | 7/2006 | Lee | A41D 19/0017 2/163 |
| 2013/0212775 | A1* | 8/2013 | Kusjanovic | A41D 19/0013 2/164 |
| 2014/0082825 | A1* | 3/2014 | Clark | A41D 19/01 2/158 |
| 2015/0033440 | A1* | 2/2015 | Lewis | A41D 19/0024 2/161.1 |

* cited by examiner

MULTI MIT

CROSS REFERENCE TO RELATED APPLICATIONS

The present application is a continuation of prior U.S. patent application Ser. No. 14/493,269, entitled "MULTI MIT", filed Sep. 22, 2014, now issued as U.S. Pat. No. 9,204,675, issued on Dec. 8, 2015, and U.S. Provisional Patent application No. 61/906,774 filed on the Nov. 20, 2013, the contents of which are hereby incorporated entirely herein by reference.

BACKGROUND OF THE INVENTION

The Multi MIT has a wide range of uses with several different aspects making this invention unique and different. Glove wearers need gloves for a variety of reasons—hand protection from severe weather conditions, heating elements, moving mechanical parts, etc. And before the invention of the Multi MIT, individuals would find it necessary to remove the entire glove from the hand to access fingertips for touch receptor ability. In other words, remove the glove to perform most any activity requiring touch receptors such as dialing a phone, shooting a gun, touch screen computers, engine repair, electrical wires, etc. By exposing the hand to severe elements runs the risk of endangering the wearer's bare hand as well as removing the glove and increases the risk of losing the removed glove.

The field of endeavor to which this invention pertains is vast. Outdoor sporting—hunting, fishing, archery; outdoor winter sports—skiing, snowboarding, sledding; construction, electrician, carpentry, mechanical, shooting ranges, trucking to name a few. Plus, the ordinary people with no other reason than to keep full hand protection while accessing the 3 most common used fingers the middle, index and thumb.

BRIEF SUMMARY OF THE INVENTION

The Multi MIT is a universal glove that has the ability to allow the user to access the middle, index and thumb fingers of both hands while still providing full hand protection. The Multi MIT has retractable finger caps on the first 3 fingers of each hand: middle, index and thumb. The fingertips can be easily accessed by retracting the fingertip caps—pull the Velcro tab (on the palmer side of the glove) up and over the distal end of each finger and connect the magnets on (the dorsal side of) the glove. The magnets for each retractable finger cap are held back by a positive magnet sewn in between the insulated fabric and just under the outer material of the glove. The positive magnet is near the distal interphalangeal joint and the negative magnet is near the metacarpo-interphalangeal joint (knuckle). With the finger caps retracted, the inner separate glove is exposed giving full hand protection while allowing the wearer to handle small pieces and touch screen capabilities without exposing bare skin to harsh weather climates and elements. The inner glove is easily added and/or removed from the outer glove and gives the wearer the option of having the inner glove protection or wearing just the insulated outer glove. The Multi Magnet is located on the bottom dorsal side of the glove (wrist) and is also sewn just under the outer fabric of the glove. The Multi Magnet is an attaching system that uses a negative magnet, fabric and a split key ring. This attaching system is connects the glove to any zipper or loop tab i.e. Ski coat, snow jacket, duffle bag, and backpack. When the wearer removes the glove, the dorsal side of the glove with the magnet, can then be attach to the Multi Magnet attaching system keeping track of the wearers glove/s.

Multi MIT hand wear is a line of gloves that are 2 gloves in one. The Multi MIT is a two-piece glove—an inner glove and an outer glove for both left and right hands. The Multi MIT design that follows pertains to both left and right hands/gloves. The Multi MIT unique design allows the middle, index, and thumb fingertips to retract over the finger exposing the inner glove and the retracted fingertip (distal phalanx) caps are held in place by magnets. One magnet is sewn into the material on the back or dorsal side of the glove; on 3 fingers—middle, index, and thumb; in two locations: 1) just at and/or slightly above the distal interphalangeal joint 2) just above the metacarpo-phalangeal joint (knuckle)—between the proximal interphalangeal joint and the metacarpo-phalangeal joint. These magnets are securely sewn under the top/outer water resistant fabric and above the inner insulated Thinsulate™ fabric. When the retractable fingertip (distal phalanx) caps are pulled over-from the palmer side (palm side) of hand/finger retracting over to the dorsal side (back of) hand/finger on the middle, index, and thumb fingers (both left and right gloves) with the finger caps secured in place on the distal side of the glove by magnets. The palmer side of the glove has breaks in the fabric with Velcro™ tabs that secure the finger caps to the palmer side of the glove and denotes the opening point of the finger cap on the middle, index, and thumb fingers. The finger caps retract by pulling the tab up and over the—palmer side to dorsal side—distal interphalangeal joint (fingertip) and the finger cap is secured by the magnets on the dorsal side of the glove/fingertip (distal interphalangeal joint).

The Multi MIT design has another magnet (larger in circumference approx. size of quarter) at the base or bottom on the dorsal side of the glove—wrist portion of the glove. This magnet is also securely sewn under the outer fabric of the glove and above the inner insulated Thinsulate™ fabric. This magnet feature of the Multi MIT allows the wearer to utilize the Multi Magnet. The Multi Magnet is a split key ring system that allows the wearer to connect the glove to any article of clothing or bag that has a zipper or loop tab. The Multi Magnet is approximately 2½" in total length. It has a ¾" split key ring attached to a piece (strap) of fabric (that is approximately 1" long×½" wide) on one end and has a ¾" round magnet at the opposite end of the split key ring. The user can thread the split key ring to any zipper or tab on any article of clothing or bag. Using the same idea as the retractable finger caps, the magnetic field will hold the Multi MIT gloves to the Multi Magnet and allows the user to keep track of the glove while using his/her bare hand. The Multi Magnet will help prevent the loss of one and/or both gloves from dropping or leaving behind as the wearer will simply remove the Multi MIT and connect the magnet from the glove to the Multi Magnet affixed via split key ring to any zipper or loop tab on any article of clothing (ski/snowboarding jackets) or bag (back pack or duffle).

The inner glove design is a form-fitting fleece spandex material with "touch screen" patches on the middle, index, and thumb fingers. The inner glove is designed to keep the exposed fingertips warm when the outer glove finger caps are retracted. The "touch screen" fabric technology allows the wearer/user to operate cell phones, computer screens and other "touch screen" technologies. The separate inner glove can be worn by itself in cooler temperatures when the outer glove is not needed. The outer glove can be worn by itself when temperatures are cold and the inner glove is not needed. Combine the two gloves together for frigid temperatures and ice/snowy weather conditions. The materials used for the outer fabric of the glove vary and include but are not limited to leather, vinyl, rubber, spandex, Thinsulate™, cotton, wool, micro-fiber, etc.—as well as any blend of the fibers and materials listed. The materials for the inner glove also vary to include but not limited to micro-fiber, spandex, fleece, wool, cotton, etc.—and any blend or combination of those fibers.

DETAILED DESCRIPTION

Figure 1:
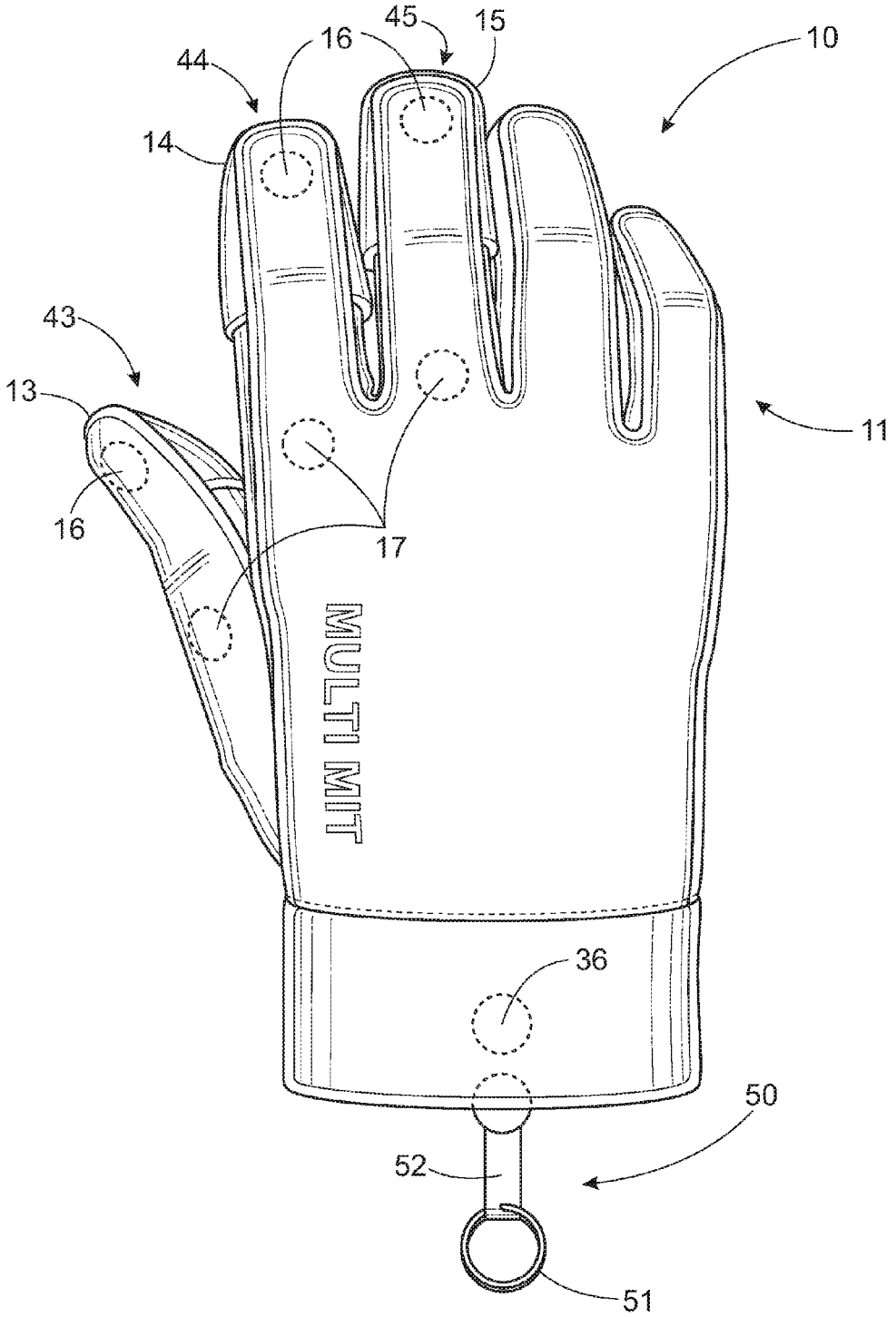
FIG. 1 is a perspective view of a glove in accordance with the present disclosure.
Figure 2:
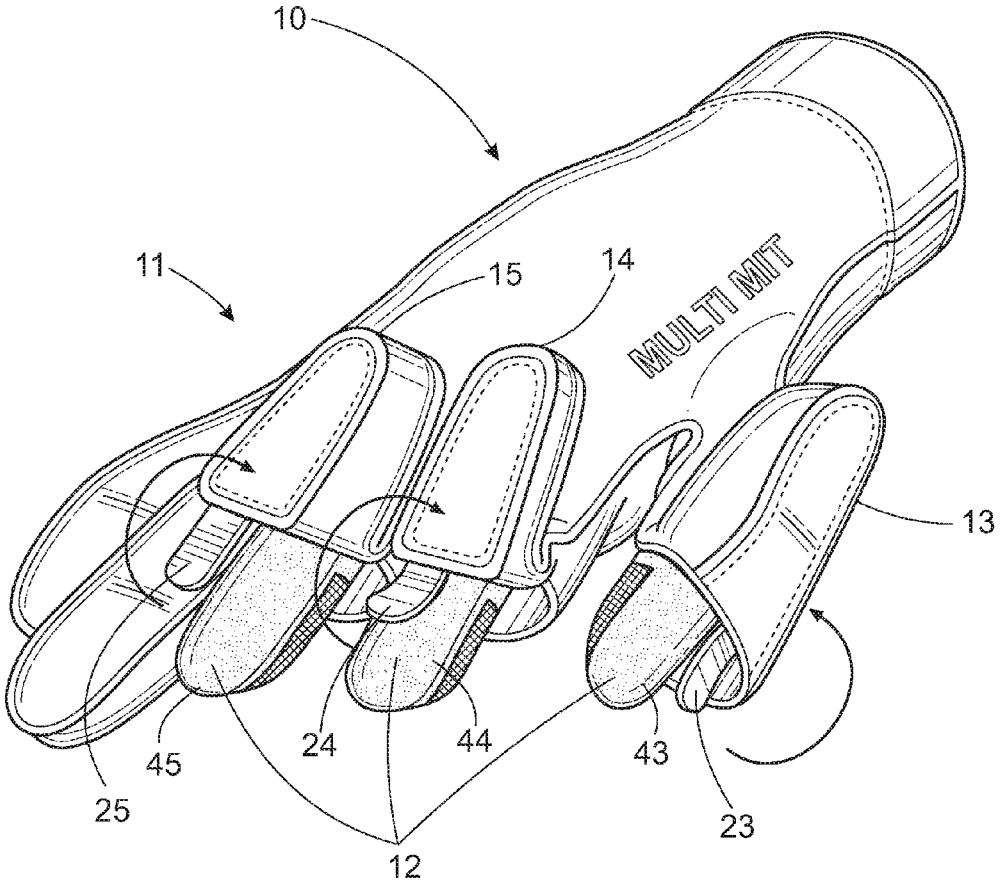
FIG. 2 is a perspective view of a glove with the fingertip caps in the retracted position in accordance with the present disclosure.
Figure 3:
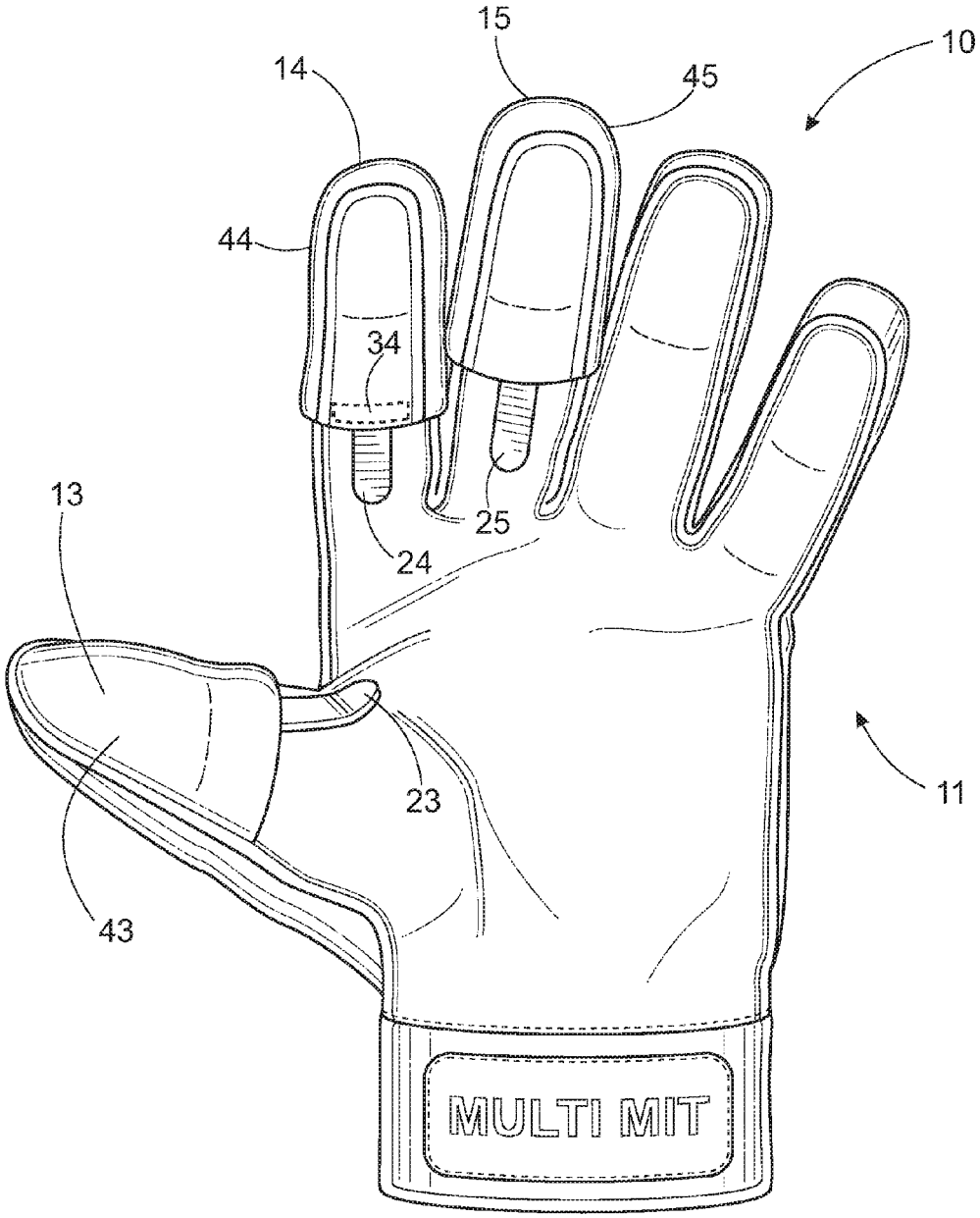
FIG. 3 is a perspective view of the palm side of a glove in accordance with the present disclosure.
Figure 4:
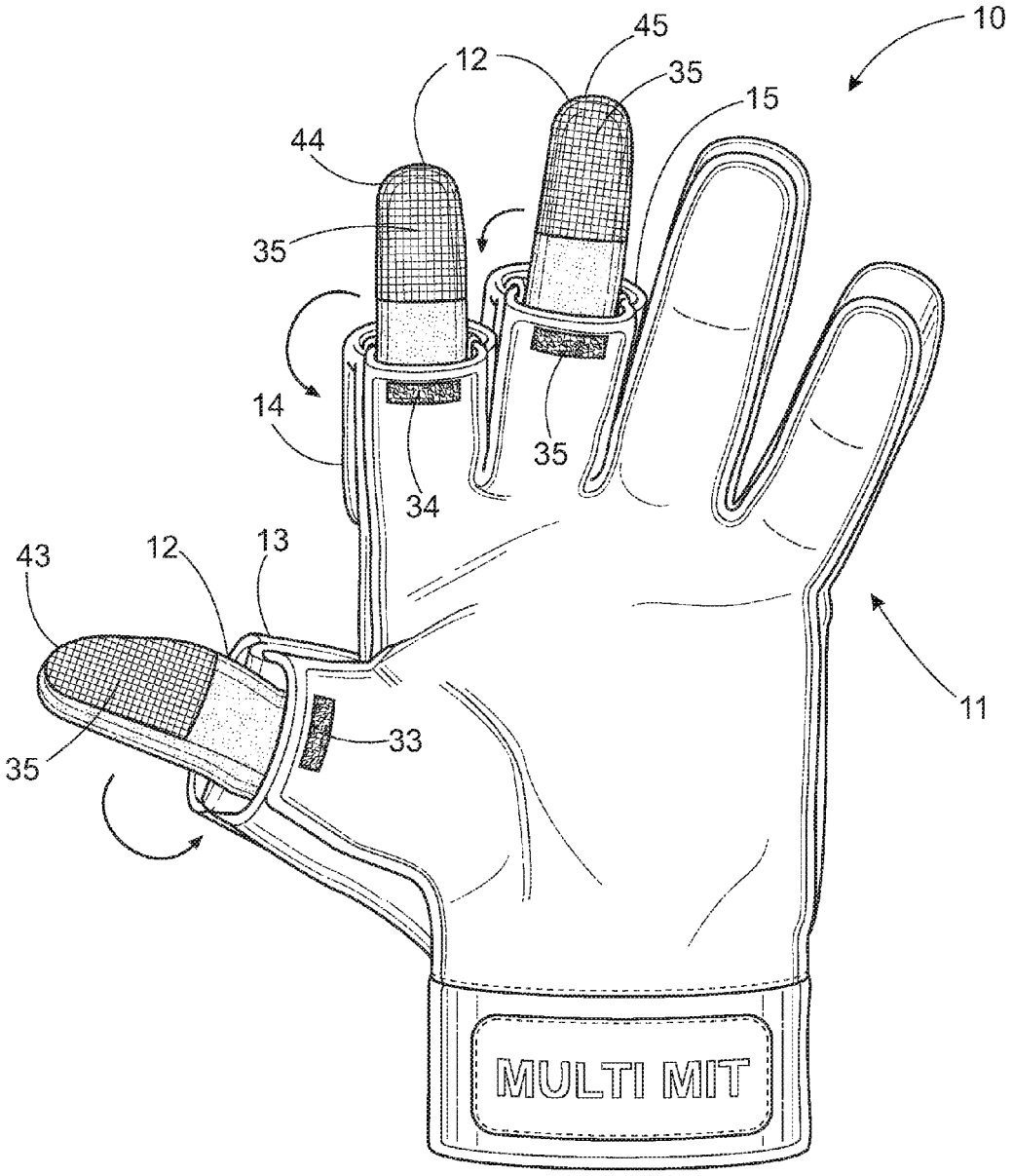
FIG. 4 is a perspective view of the palm side of a glove with the fingertip caps in the retracted position in accordance with the present disclosure.
Figure 5:
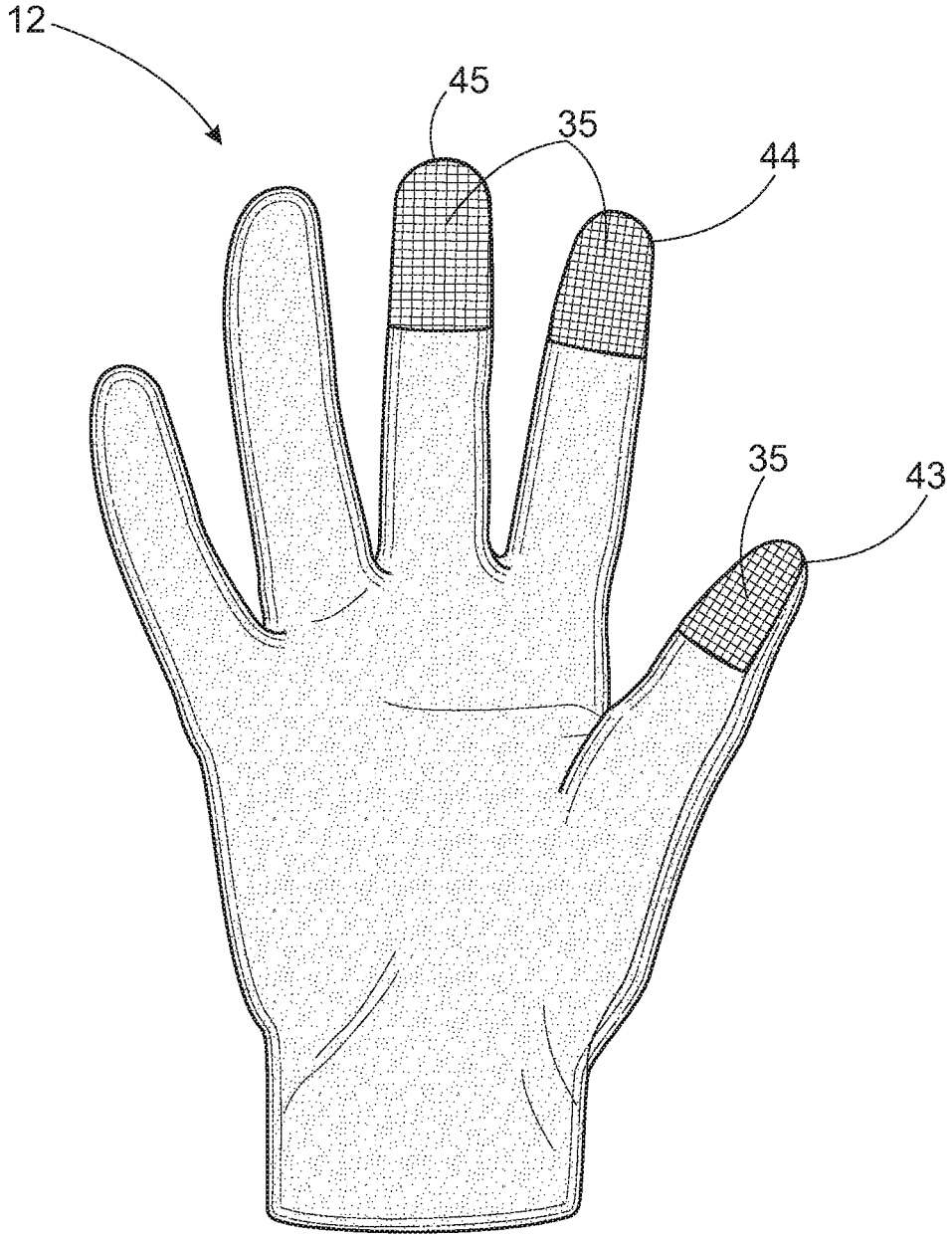
FIG. 5 is a perspective view of the palm side of a glove liner in accordance with the present disclosure.
Figure 6:
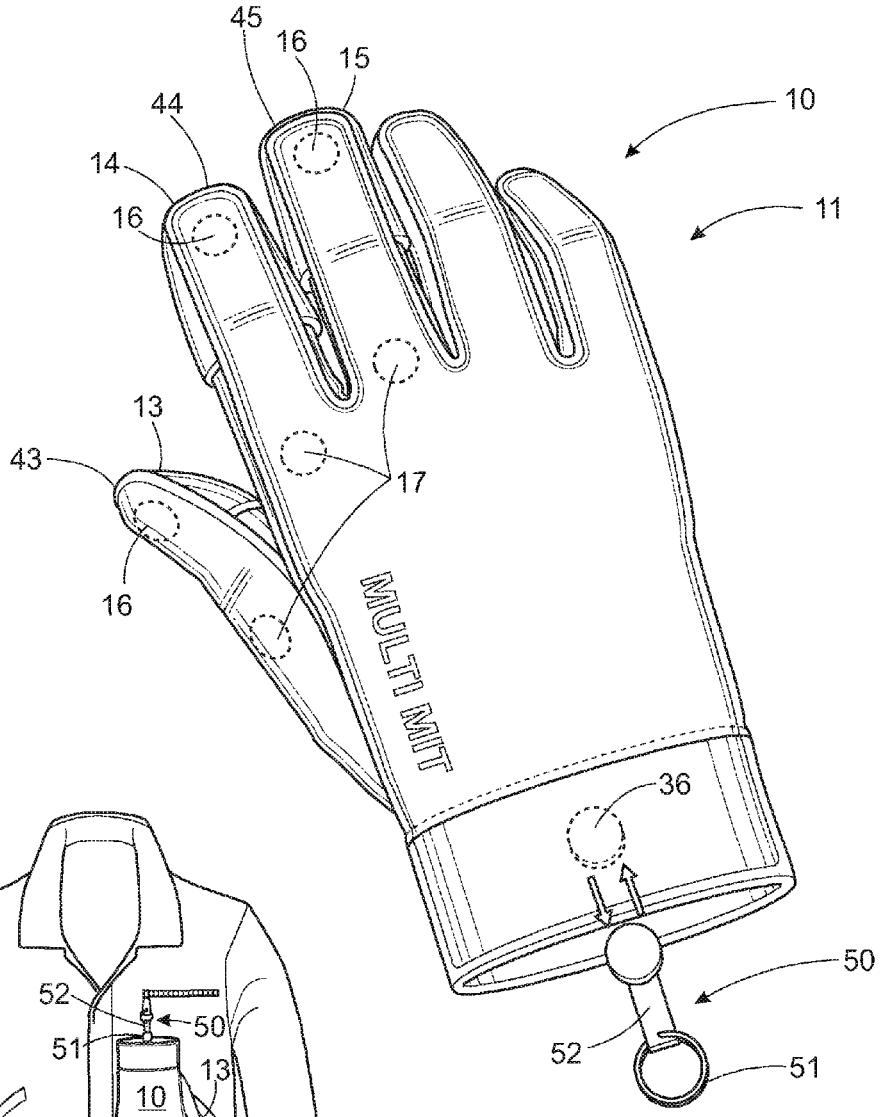
FIG. 6 is a perspective view of a glove including a removable clip in accordance with the present disclosure.
Figure 6A:
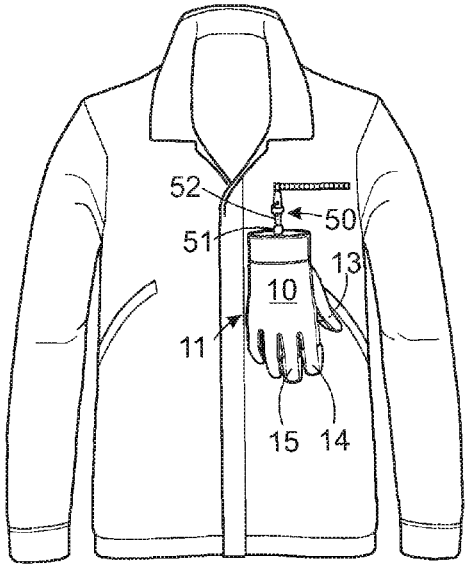
FIG. 6*a* is a perspective view of a glove attached to a jacket using a removable clip in accordance with the present disclosure.

The technical features of the Multi MIT 10 are the retractable finger points on and/or near the metacarpo-interphalangeal joint on the middle 45, index 44 and thumb 43 fingers. On the dorsal side of the glove, are magnets that are sewn between the insulated material and the outer fabric which connect when the finger caps 13, 14 and 15 are retracted. The finger caps 13, 14 and 15 are held back by a positive 16 and a negative 17 magnet on the dorsal side of the glove that firmly holds the finger caps 13, 14 and 15 in place. The retracted caps access the inner spandex fleece glove 12 that has touch screen material patches 18, 19 and 20 on the tips of the middle 45, index 44, and thumb 43 fingers on the palmer side of the inner glove 12. The inner glove 12 is designed to give the wearer fingertip sensory reception, dexterity and allow touch screen capabilities while providing mild fingertip protection with the finger caps 13, 14 and 15 retracted. When the finger caps 13, 14 and 15 are in place for full hand protection, the caps are firmly held in place (on the palmer side) near the proximal-interphalangeal joint (middle knuckle) with hook and loop tabs 23, 24 and 25. These tabs keep the finger caps 13, 14 and 15 securely in place. The technical feature of the Multi Magnet is ability to allow the user a separate system to hand on to the gloves upon removal without getting in the wearer's way.

The Multi MIT 10 is a two-piece glove—an inner glove 12 and an outer glove 11 for both left and right hands. The Multi MIT 10 design that follows pertains to both left and right hands/gloves. The Multi MIT 10 unique design allows the middle 45, index 44, and thumb 43 fingertips to retract over the finger exposing the inner glove 12 and the retracted fingertip (distal phalanx) caps 13, 14 and 15 are held in place by magnets. One magnet is sewn into the material on the back or dorsal side of the glove; on 3 fingers—middle 45, index 44, and thumb 43; in two locations: 1) just at and/or slightly above the distal interphalangeal joint 2) just above the metacarpo-phalangeal joint (knuckle)—between the proximal interphalangeal joint and the metacarpo-phalangeal joint. These magnets are securely sewn under the top/outer water resistant fabric and above the inner insulated Thinsulate™ fabric. This system allows the retractable fingertip (distal phalanx) caps 13, 14 and 15 to be pulled over-from the palmer side (palm side) of hand/finger retracting over to the dorsal side (back of) hand/finger on the middle 45, index 44, and thumb 43 fingers with the finger caps 13, 14 and 15 secured in place on the distal side of the glove by magnets. The glove pattern calls for one constant piece of fabric on the dorsal side of the glove. There is no break in the fabric at the retraction fold point. The retraction fold point is directly over the distal interphalangeal joint of the middle 45, index 44, and thumb 43 fingers. On the palmer side of the glove, the design requires the pattern to have a break in the fabric at the distal interphalangeal joint of the middle 45, index 44, and thumb 43 fingers. This break in the fabric has hook and loop tabs that secure the finger caps to the palmer side of the glove and denotes the opening point of the finger cap on the middle 45, index 44, and thumb 43 fingers. The finger caps 13, 14 and 15 retract by pulling the tab up and over the—palmer side to dorsal side—distal interphalangeal joint (fingertip) and the finger cap is secured by the magnets on the dorsal side of the glove/fingertip (distal interphalangeal joint).

The inner glove 12 design is a form-fitting fleece spandex material with "touch screen" patches 35 on the middle 45, index 44, and thumb 43 fingers. The inner glove 12 is designed to keep the exposed fingertips warm when the outer glove 11 finger caps 13, 14 and 15 are retracted. The "touch screen" fabric technology allows the wearer/user to operate cell phones, computer screens and other "touch screen" technologies. The separate inner glove 12 can be worn by itself in cooler temperatures when the outer glove 11 is not needed. The outer glove 11 can be worn by itself when temperatures are cold and the inner glove 12 is not needed. Combine the two gloves together for frigid temperatures and ice/snowy weather conditions. The materials used for the outer fabric of the glove vary and include but are not limited to leather, vinyl, rubber, spandex, Thinsulate™, cotton, wool, micro-fiber, etc.—as well as any blend of the fibers and materials listed. The materials for the inner glove 12 also vary to include but not limited to micro-fiber, spandex, fleece, wool, cotton, etc.—and any blend or combination of those fibers.

The Multi MIT 10 design has another magnet 36 (larger in circumference) at the base or bottom on the dorsal side of the glove—wrist portion of the glove. This magnet 36 is also securely sewn under the outer fabric of the glove and above the inner insulated Thinsulate™ fabric. This magnet feature of the Multi MIT 10 allows the wearer to utilize the Multi Magnet 50. The Multi Magnet 50 is a split key ring system that allows the wearer to connect the glove to any article of clothing or bag that has a zipper or loop tab. The Multi Magnet 50 is approximately 2½" in total length. It has a ¾' split key ring 51 attached to a piece (strap) of fabric 52 (that is approximately 1" long×½" wide) on one end and has a ¾" round magnet 36 at the opposite end of the split key ring 51. The user can thread the split key ring 51 to any zipper or tab on any article of clothing or bag. Using the same idea as the retractable finger caps 13, 14 and 15, the magnetic field will hold the Multi MIT 10 gloves to the Multi Magnet 50 and allows the user to keep track of the glove while using his/her bare hand. The Multi Magnet 50 will help prevent the loss of one and/or both gloves from dropping or leaving behind as the wearer will simply remove the Multi MIT 10 and connect the magnet 36 from the glove to the Multi Magnet 50 affixed via split key ring 51 to any zipper or loop tab on any article of clothing (ski/snowboarding jackets) or bag (back pack or duffle).

The Multi MIT 10 design solves a variety of problems that exist with gloves and mittens that are available on the market today. We have improved the design of the glove to give the user full hand protection while using the middle 45, index 44, and thumb 43 fingers plus added a feature to help prevent the loss of one or both of the gloves. The ability to access finger tips from gloves (as opposed to mittens) without exposing the entire hand is literally non-existent on the market. There is another glove (not on the market, but patented) that's design has the index and middle whole finger sleeves to be pulled over the hand and tucked away in the cuff of the glove. This glove design has some obvious errors with the potential problems from the finger sleeves 'un-tucking' and getting in the way of the wearer. The Multi MIT 10 allows the wearer to expose the three most used fingers middle 45, index 44, and thumb 43 as opposed to current mitten features that expose four fingers and the thumb 43 is still covered in fabric. The Multi MIT 10 gives the option of two gloves in one. The inner spandex fleece glove 12 with "touch screen" fabric patches 35 on the middle 45, index 44, and thumb 43 fingers and an outer glove 11 insulated with Thinsulate™ and designed to retract the finger caps 13, 14 and 15 from palmer side to dorsal side on the middle 45, index 44, and thumb 43 fingers. The two-in-one glove gives the wearer the option of wearing the inner glove 12 or outer glove 11 alone—dependent on weather conditions and/or wearer preference. The hook and loop tabs 33 on the palmer side of the outer glove securely fastens the finger caps 13, 14 and 15 in place for full hand coverage and the magnets 16 and 17 on the dorsal side of the glove securely fastens the retracted finger caps 13, 14 and 15 for easy use of exposed (with or without inner glove 12) middle 45, index 44, and thumb 43 fingers. Currently our Multi MIT 10 design uses hook and loop tabs 33 on the dorsal side of the glove to secure the retracted finger caps 13, 14 and 15, and we changed the design to magnets 16 and 17 rather than hook and loop tabs that will prove inoperable with snow impacted in the hook and loop. The final improvement of this glove is the added Multi Magnet 50 feature. This feature is a magnet 36 (larger in circumference than the magnets 16 and 17 that secure the retracted finger caps 13, 14 and 15) at the base or bottom on the dorsal side of the glove—wrist portion of the glove. This magnet 36 is also securely sewn under the outer fabric of the glove and above the inner insulated Thinsulate™ fabric. This magnet 36 is used to attached/attract to the Multi Magnet 50 that is fastened via split key ring 51 to a jacket zipper or tab (any zipper on any article of clothing or bag). The Multi Magnet 50 solves the problem of losing a glove (or gloves) and eliminates the dangling glove at the end of a coat sleeve. The Multi Magnet 50 feature secures the gloves to the wearer in which the glove will never leave the owners side.

The Multi MIT 10 is a 2-in-1 glove system: an inner glove and an outer glove. The outer glove 11 comprises of retractable finger caps 13, 14 and 15 on both the left and the right glove of the middle 45, index 44, and thumb 43 fingers. These retractable finger caps 13, 14 and 15 on each of the middle 45, index 44, and thumb 43 fingers are made from a seam that creates the opening on the palmer side of each of the said fingers. This seam/opening is located at the proximal interphalangeal joint—middle knuckle of the middle 45, index 44, and thumb 43 fingers on both the left and the right gloves. This seam or opening allows the middle 45, index 44, and thumb 43 fingers on both hands to become exposed by pulling the hook and loop tabs 23, 24 and 25 on each of the seams located at the bottom of the openings of the retracting points. By pulling the tabs 23, 24 and 25 the retractable finger caps 13, 14 and 15 pull over each fingertip—palmer side to dorsal side of hand—exposes the designated inner gloved 12 or bare finger(s) 13, 14 and 15. The glove pattern calls for one constant piece of fabric on the dorsal side of the glove. There is no break in the fabric at the retraction fold point. The retraction fold point is directly over the distal interphalangeal joint of the middle 45, index 44, and thumb 43 fingers. On the palmer side of the glove, the design requires the pattern to have a break in the fabric at the distal interphalangeal joint of the middle 45, index 44, and thumb 43 fingers. This break in the fabric has hook and loop tabs 33 that secure the finger caps 13, 14 and 15 to the palmer side of the glove and denotes the opening point of the finger cap on the middle 45, index 44, and thumb 43 fingers.

The Multi MIT 10 is a glove comprising of retractable fingertip caps on the middle 45, index 44, and thumb 43 fingers and on both the left and right hands that are held back in place by magnets 16 and 17. These magnets 16 and 17 are sewn in two spots on each retractable finger point under the fabric. One magnet 17 is sewn into the material on the back or dorsal side of the glove; on 3 fingers—middle 45, index 44, and thumb 43; in two locations: 1) just at and/or slightly above the distal interphalangeal joint 2) just above the metacarpo-phalangeal joint (knuckle)—between the proximal interphalangeal joint and the metacarpo-phalangeal joint. The negative magnets 17 on the middle 15, index 14, and thumb 13 retractable fingers of both hands are just above the metacarpo interphalangeal joint (knuckles). The positive magnets 16 are located just below each distal interphalangeal joint of the middle 45, index 44, and thumb 43 fingers of both hands. The magnets 16 and 17 on both hands are sewn under the fabric on the top of the gloves and not visible. The magnets 16 and 17 are of normal grade and approximately the size of a penny. The primary responsibility of the magnets 16 and 17 is to secure the retracted finger caps 13, 14 and 15 to the dorsal side of the glove 11 and out of the user's way. When the retracted fingers are pulled back and held in place by the magnets 16 and 17 this allows the inner glove 12 (or bare fingers 43, 44 and 45) to be exposed. When the inner glove 12 is exposed on any of the retracted fingers it allows the user to have more sensory receptor feeling and finger dexterity to perform small piece handling or using of a touch screen device without removing the entire outer glove 11, thus still providing full hand protection.

Multi MIT 10 is a glove comprising of an inner separate glove 12 on both the left and the right hands. This inner glove 12 is made with a more form fitting fabric than the outer glove 11 (such as spandex, fleece, polyester or combination thereof) with touch screen fabric patches 35 on the tip of the middle 45, index 44 and thumb 43 fingers on both hands. This fabric allows for extra warmth in extreme weather conditions when combined with its outer glove 11 counterpart. This design was specifically made to give the wearer extra protection, finger dexterity, and improved sensory reception as well as touch screen capabilities. When the finger caps 13, 14 and 15 are retracted, the inner glove 12 provides mild fingertip protection from harsh weather elements while the wearer is performing tasks at hand. When any of the retracted finger caps 13, 14 and 15 on either hand are pulled back it exposes the inner glove 12 or bare hand and gives the wearer fingertip sensory reception and dexterity for small piece handling yet protects the fingers from the weather. When the retracted finger caps 13, 14 and 15 are open and the inner glove 12 is exposed it also allows the user the ability to operate touch screen devices with ease while protecting the fingers from the elements.

Multi MIT 10 is a glove comprising of a third component of an attachment system that consists of a quarter sized (approximate) positive magnet 16 that sewn into the glove 11 (on top of the insulation and under outer fabric) located on the dorsal side of the glove 11 (on top of the wrist). The magnet 16 is strong enough to allow fabric coverage and gives the glove a more appealing aesthetic look. The inside fabric location of the magnet 16 not only hides the magnet from view but cushions the magnet (via insulation) allowing for maximum comfort as the wearer can't feel the magnet inside the glove while wearing it. The design of the attachment system is a separate unit (from the 2-in-1 glove) with the connecting negative magnet 36 is incased in a separate piece of nylon material attached to a split key ring 51. This attachment piece makes up the attachment system called the Multi Magnet 50. The Multi Magnet 50 is a separate detachable system that allows the user of the Multi MIT 10 to simply attach the Multi Magnet 50 to any zipper or backpack by threading the split key ring 51 around any loop tab or zipper. This then allows the user the ability to hang the Multi MIT 10 glove to their person through the magnetic contact. When the user needs the gloves they simply pull the Multi MIT 10 from the Multi Magnet 50 that will stay attached to the coat or backpack by the nylon piece and split key ring 51. The magnetic connection will break when the user firmly tugs on the Multi MIT 10. The Multi Magnet 50 keeps the Multi MIT 10 gloves free from the user's hands when not in use, but in effect never leaving their side.

The invention claimed is:

1. A method of using a glove system, the method comprising:

placing an inner glove on a hand of a user;

placing an outer glove over the inner glove on the hand of the user, wherein the outer glove comprises retractable finger caps on middle, index and thumb fingers of the outer glove, each retractable finger cap having an opening located proximal an interphalangeal joint, wherein the retractable finger caps on the middle, index and thumb fingers each operate independent of the other finger caps to move between an exposed and a secured position;

moving one of the retractable finger caps between the exposed position from the secured position by folding the finger cap along a fold point on a dorsal side of the glove to expose the inner glove of the finger corresponding to the moving finger cap in the exposed position and covering the inner glove of the finger corresponding to the moving finger cap in the secured position; and removably coupling the tab to a palmer side of the outer glove to secure the retractable finger cap in the secured position.

2. The method of claim 1, wherein moving one of the finger caps further comprises using a tab coupled adjacent an opening of each of the retractable finger caps, wherein the tab assists in moving the corresponding retractable finger cap between the exposed and the secured position.

3. The method of claim 2, further comprising releasably coupling the retractable finger caps in the exposed position by use of a magnet coupled to the retractable finger cap and a magnet coupled onto the dorsal side of the outer glove corresponding of the magnets coupled to the retractable finger caps.

4. The method of claim 1, further comprising operating a touch screen device when the finger cap is in the exposed position in response to using the inner glove comprising touch screen fabric on the exposed finger.

* * * * *